United States Patent [19]

Westbrook

[11] 4,387,073

[45] Jun. 7, 1983

[54] GOLD BASED ELECTRICAL CONTACT MATERIALS

[75] Inventor: Jack H. Westbrook, Ballston Spa, N.Y.

[73] Assignee: The United States of America as represented by the Secretary of the Navy, Washington, D.C.

[21] Appl. No.: 299,750

[22] Filed: Sep. 8, 1981

[51] Int. Cl.[3] ..... C22C 5/02; H01H 1/02

[52] U.S. Cl. ..... 420/507; 200/265

[58] Field of Search ..... 75/165, 951; 252/514, 252/521, 517, 512, 518; 200/265, 266; 420/507

[56] References Cited

U.S. PATENT DOCUMENTS

| | | | |
|---|---|---|---|
| 1,248,621 | 12/1917 | Cooper | 200/266 X |
| 2,504,906 | 4/1950 | Tremblay | 200/265 |
| 2,556,921 | 6/1951 | Hirsch et al. | 75/165 X |
| 3,037,064 | 5/1962 | Rosi et al. | 75/165 X |
| 3,729,794 | 5/1973 | Douglass | 29/182.1 |
| 3,951,872 | 4/1976 | Neely | 252/514 X |
| 4,018,599 | 4/1977 | Hill et al. | 200/266 X |
| 4,018,630 | 4/1977 | Hill et al. | 73/175 A X |
| 4,081,644 | 3/1978 | Davies | 75/165 X |
| 4,147,538 | 4/1979 | Yajima et al. | 75/229 |
| 4,279,649 | 7/1981 | Fujiwara et al. | 75/173 A |

*Primary Examiner*—L. Dewayne Rutledge
*Assistant Examiner*—David A. Hey
*Attorney, Agent, or Firm*—Robert F. Beers; Frederick A. Wein

[57] ABSTRACT

Gold based contact materials fabricated by directional solidification and exhibiting increased strength, hardness, wear resistance and undegraded electrical conductivity, are presented. An eutectic structure comprises a matrix metal consisting essentially of gold and a second phase rich in an alloying material. The second phase rich in an alloying material is disposed within the matrix metal in a plurality of elongated zones formed by directional solidification of the alloy with each zone having an elongated axis generally normal to a contact boundary surface of the solid. The second phase is rich in an alloying material selected from a group of alloying elements consisting of Be, Ca, Sr, La, Na, Th, Zr, Hf, Sb, Ge, Mo, Si and the rare earth elements. Selected ones of the alloying elements can be subjected to internal oxidation for forming hard, oxide particles of the second phase material.

14 Claims, 1 Drawing Figure

GOLD BASED ELECTRICAL CONTACT MATERIALS

BACKGROUND OF THE INVENTION

The present invention relates to materials suitable for use as contact materials for low energy slip rings, and more particularly, to gold based contact materials having elongated zones of a second phase therein.

Materials suitable for use in low energy slip rings should exhibit high wear resistance and low contact resistance. Accordingly, such materials must have high conductivity, high hardness and wear resistance, high tarnish resistance, low contact noise, and little or no tendency towards catalytic formation of friction polymers. In the past, such considerations have led to a virtually exclusive dependence upon gold based materials. Currently used gold-based materials utilize cold working, solid solution hardening, precipitation hardening, or order hardening which generally benefit strength, hardness and wear resistance but have detrimental effects on the electrical and chemical properties of gold.

Nickel, cobalt, or cadmium hardened electroplated gold exhibit high hardness, high wear resistance and have a reasonably high conductivity, but such materials often have included contaminants such as, KCN, porosity, codeposited polymers, and the like. Additionally, properties of hardened electroplated gold are strongly dependent upon the substrate and plating conditions. Thus, consistently high quality electroplates require not easily achieved stringent controls during processing.

With regard to bulk alloys of gold, the choice is limited because many alloying metals which benefit strength or wear resistance severely degrade the electrical and chemical properties of gold. Prior Art approaches include dispersion-hardened gold with insoluble additives such as oxides, carbides, or refractory metals such as Mo, or order hardened gold such as $Au_3Pt$.

Accordingly, it is desirable to provide gold based alloy material which will exhibit high hardness, high wear resistance, and high strength, combined with high conductivity.

SUMMARY OF THE INVENTION

Briefly, gold based contact materials chosen from systems exhibiting eutectic formation, fabricated by directional solidification and exhibiting increased strength, hardness, wear resistance and undegraded electrical conductivity, are presented. The eutectic and near-eutectic alloys in such systems comprise a matrix metal consisting essentially of gold and a second phase rich in an alloying element. The alloying element is disposed within the matrix metal in a plurality of elongated zones formed by directional solidification of the eutectic or near-eutectic alloys with each zone having an elongated axis generally normal to a contact boundary surface of the solid body. The alloying element is selected from a group of elements consisting of Be, Ca, Sr, La, Na, Th, Zr, Hf, Sb, Ge, Mo, Si, and the rare earth elements. Selected ones of these alloying elements can be subjected after freezing to internal oxidation for forming hard, elongated oxide particles of the second phase material.

OBJECTS OF THE INVENTION

Accordingly, it is an object of the present invention to provide gold based contact materials having a plurality of elongated zones of a second phase material within an essentially pure gold matrix. Another object of the present invention is to provide gold based materials with a gold-rich near-eutectic composition. Yet another object of the present invention is to provide gold based contact materials formed by directional solidification of a near-eutectic composition for obtaining a structure in which the second phase material is distributed as fine fibers or zones aligned perpendicular to a boundary surface subject to a mechanical wiping contact action of a contactor. A further object of the present invention is to provide an electrical contact material having second phase material fibers within a essentially pure gold matrix formed by directional solidification wherein the material forming the fibers is converted to a hard oxide by internal oxidation within the solid solution.

Further objects and advantages of the present invention will become apparent as the following description proceeds and the features of novelty characterizing the invention will be pointed out with particularity in the claims annexed to and forming a part of this specification.

DESCRIPTION OF THE DRAWING

For a better understanding of the present invention reference may be had to the accompanying drawing wherein.

DETAILED DESCRIPTION OF THE PREFERRED EMBODIMENT

Figure 1:
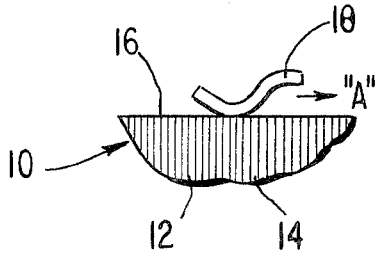
FIG. 1 is a representation of a portion of a gold based material having elongated zones which are wipable by an electrical contactor.

Referring now to the drawing wherein the same reference numerals have been applied to like parts, in the exemplary embodiment the present invention is directed to gold alloy systems of the eutectic type wherein the alloying element has negligible solubility in gold, where the eutectic composition lies in the gold-rich side of the system, and where the second phase of the eutectic is either itself intrinsically hard relative to the gold or can be hardened by oxidizing treatment. As used herein, the term eutectic is defined as including those compositions sufficiently near the eutectic that the structure of the alloy is predominantly that of the eutectic constituent.

The alloy systems shown in Table I are a listing of eutectic type alloy systems of the exemplary embodiment wherein the second phase is a gold-rich intermetallic compound. The alloy systems of Table II in the exemplary embodiment are of the eutectic type wherein the second phase is essentially a pure element. In either case, the desirable compositions will lie near and at the eutectic composition.

TABLE I

| System | Eutectic Temp °C. | Second Phase ($Au_nX$) |
|---|---|---|
| Au—Be | 580 | $Au_3Be$ |
| Au—Ca | 804 | $Au_4Ca$ |
| Au—Sr | 890 | $Au_5Sr$ |
| Au—La | 798 | $Au_6La$ |
| Au—Rare Earth | 800–1100 | $Au_4$Rare Earth or $Au_6$Rare Earth |
| Au—Na | 876 | $Au_2Na$ |

TABLE I-continued

| System | Eutectic Temp °C. | Second Phase ($Au_nX$) |
|---|---|---|
| Au—Th | .810 | $Au_3Th$ |
| Au—Zr | 1065 | $Au_4Zr$ |
| Au—Hf | 700 | $Au_5Hf$ |
| Au—Sb | 360 | $AuSb_2$ |

TABLE II

| System | Eutectic Temp. °C. | Second Phase (X) |
|---|---|---|
| Au—Ge | 356 | Ge |
| Au—Mo | 1054 | Mo |
| Au—Si | 370 | Si |

While useful properties result from simply casting the disclosed materials of near-eutectic composition, the particularly attractive properties required for contact materials for low energy slip rings are enhanced by directional solidification of the eutectic for obtaining the structure in which the hardening phase, e.g., $Au_nX$ or X, is distributed as fine fibers or zones aligned generally perpendicular to the direction of motion of a mechanical contactor as shown in FIG. 1 and simultaneously parallel to the direction of electrical current flow through the contactor. It is also within the contemplation of the present invention that slip rings and contacts can be constructed of other eutectic contact materials with elongated zones within other matrix metals.

Referring now to FIG. 1, there is shown a portion of a contactor contacting the eutectic type directionally solidified alloy having directional solidification, generally designated 10, wherein a multiplicity of hard fibers or elongated zones 12 are disposed within the gold matrix 14. The fibers or zones 12 are generally parallel to each other and have an elongated longitudinal axis generally perpendicular to and terminating at a contact or boundary surface 16. A contactor 18 wipably engages the boundary surface 16 with a relative direction of motion shown by the arrow "A". In the exemplary embodiment the zones 12 are generally perpendicular to the boundary 16, however, it is within the contemplation of the present invention that the zones 12 can be oriented at any angle to the boundary surface 16.

For the alloys subjected to directional solidification, the hardening and wear resistance features of the directional solidification are maintained throughout the manufacturing process, e.g., the formation of the boundary surface 16, and the service life of the slip ring, such that the electrical conduction of the slip ring is maintained by the virtually pure gold matrix and is not impeded by the hard second phase forming the zones 12.

The intermetallic compounds $Au_nX$ of Table I can be sufficiently hard to impart the desired improvement in the mechanical properties of the composite alloy. For alloy systems of Table II, the mechanical property improvements result from the dispersion of a second phase of essentially a pure element and the mechanical properties of the directionally solidified composite can be further improved by subjecting the alloy to an oxidizing heat treatment as disclosed hereinafter such that for systems such as Au-Ge or Au-Si, the fiber second phase is converted to the hard, refractory oxide of $GeO_2$ or $SiO_2$ respectively without alteration of the inert gold matrix.

More particularly, the following is exemplary of the alloy systems disclosed in Table II:

Au-Si alloys from 2.2 to 3.25 percent by weight of Si have been intensely investigated. For such systems the Au is 99.999 percent pure and semiconductor grade Si is at least 99.99 percent pure. 50 gram charges were induction melted in an argon atmosphere in alumina crucibles and poured into alumina molds approximately 1 cm in diameter by 7.5 cm at 1000° C. These alloys were directionally solidified by remelting in an alumina crucible resting on a stainless steel chill block which in turn is rested upon a water-cooled copper base plate. The directional solidification was effected by gradually lowering the crucible containing the molten alloy through the bottom of the furnace with the withdrawal rate being controlled by a variable speed motor coupled to a belt and gear mechanism.

Slight variations in composition near the eutectic, e.g., 3.25 percent Si for Au-Si alloys, had small effect on the volume fraction or morphology of the eutectic. However, variations in cooling rate effected the interfiber spacing.

The oxides of the elements of Table II can be formed by internal oxidation of the element of the directionally solidified alloy by subjecting the alloy to oxidizing atmospheres containing oxygen e.g., 1000° C. for 50 hrs. in flowing air, for a predetermined time at a temperature below the melting temperature of the matrix material. It is understood that other oxidizing parameters can be used, e.g., pure oxygen, other temperatures and time of exposure. The percentage of the reactive phase of the alloy oxidized by internal oxidation depends upon the temperatures and time of exposure of the alloy, the fineness of the dispersion of the second phase, and the concentration of oxygen in oxidizing atmosphere.

Thus, gold based contact materials fabricated by directional solidification are presented. A near-eutectic alloy comprising a matrix metal consisting essentially of gold and a second phase rich in an alloying element is shown. The alloying element is distributed within the matrix metal as a plurality of elongated zones formed by directional solidification of the alloy with each zone having an elongated axis generally normal to a contact boundary surface. Selected ones of the alloying elements can be subjected to internal oxidization for forming hard, elongated oxide particles of the second phase material. The resulting materials exhibit increased strength, hardness, wear resistance and undegraded electrical conductivity.

While there has been illustrated and described what is at present considered to be a preferred embodiment of the present invention, it will be appreciated that numerous changes and modification are likely to occur to those skilled in the art and it is intended in the appended claims to cover all those changes and modifications which fall within the true spirit and scope of the present invention.

What is claimed as new and desired to be secured by Letters Patent is:

1. An electrical contact having as a contact material an alloy comprising:

an eutectic structure comprising a matrix metal and a second phase rich in an alloying material, the second phase rich in an alloying material being disposed in a plurality of elongated zones within the matrix metal.

2. The alloy of claim 1 wherein the eutectic structure has a boundary surface and the elongated zones are disposed generally parallel to each other with each zone having an elongated axis terminating at the boundary surface.

3. The alloy of claim 2 wherein the matrix metal consists essentially of gold.

4. The alloy of claim 3 wherein the alloying material is selected from a group of elements consisting of Be, Ca, Sr, La, Na, Th, Zr, Hf, Sb, Ge, Mo, Si and the rare earth elements.

5. The alloy of claim 3 wherein the alloying material is selected from a group consisting of the oxides of Ge, Si, and Mo.

6. The alloy of claim 5 wherein the oxides of Ge, Si, and Mo are respectively produced by internal oxidation of at least a portion of the elements Ge, Si and Mo within the second phase rich in an alloying material.

7. The alloy of claim 1 wherein the plurality of elongated zones of the second phase rich in an alloying material within the matrix material is produced by directional solidification.

8. A method for producing materials suitable as an electrical contact material comprising the steps of:

providing an eutectic structure comprising a matrix material and a second phase rich in an alloying material, and directionally solidifying the eutectic structure to form elongated zones of the second phase rich in an alloying material within the matrix material.

9. The method of claim 8 wherein the matrix material consists essentially of gold.

10. The method of claim 9 wherein the alloying material is selected from a group of elements consisting of Be, Ca, Sr, La, Na, Th, Zr, Hf, Sb, Ge, Mo, Si, and the rare earth elements.

11. The method of claim 10 further comprising the step of internal oxidization of at least a portion of the elements Ge, Si, and Mo for respectively forming hard second phase oxide particles of Ge, Si, and Mo.

12. An electrical contact having as a contact material an alloy comprising:

an eutectic structure comprising a matrix metal consisting essentially of gold and a second phase rich in an alloying material, the eutectic structure having a contact boundary surface, the second phase rich in an alloying material being generally disposed in a plurality of elongated zones oriented generally parallel to each other with each zone having an elongated axis generally normal to the contact boundary surface, the elongated zones having been formed by directional solidification of the alloy, the second phase rich in an alloying material comprising hard second phase oxide particles formed by internal oxidation within the matrix metal by subjecting the matrix metal to an oxidizing atmosphere containing oxygen for a predetermined period of time at a temperature below the melting temperature of the matrix metal.

13. A gold based electrical contact material comprising:

an eutectic structure comprising a matric metal consisting essentially of gold, a second phase rich in an alloying element consisting of one of the elements Ge, Si, and Mo, and the oxide of the alloying element, the eutectic structure having a contact boundary surface, the second phase rich in an alloying material being generally disposed in a plurality of elongated zones oriented generally parallel to each other with each zone having an elongated axis generally normal to the contact boundary surface, the elongated zones having been formed by directional solidification of the alloy, the oxide of the element having been formed by internal oxidation by subjecting the matrix metal to an oxidizing atmosphere containing oxygen at a temperature below the melting temperature of the matrix metal.

14. A gold based electrical contact material produced by a process comprising the steps of:

providing an eutectic structure comprising a matrix metal consisting essentially of gold and a second phase rich in an alloying element selected from a group of elements consisting of Ge, Si, and Mo, the second phase rich in an alloying material being generally disposed in a plurality of elongated zones oriented generally parallel to each other, the elongated zones having been formed by directional solidification of the alloy and subjecting the matrix metal to an oxidizing atmosphere containing oxygen for a predetermined period of time for oxidizing at least a portion of the alloying element by internal oxidation to form hard, second phase oxide particles.

* * * * *